US006027316A

United States Patent [19]

Wang

[11] Patent Number: 6,027,316

[45] Date of Patent: Feb. 22, 2000

[54] AIR PUMP CAPABLE OF INFLATING AN INFLATABLE OBJECT REGARDLESS OF AIR PRESSURE LEVEL IN THE INFLATABLE OBJECT

[76] Inventor: Lopin Wang, 17F, No. 696, Sec. 4, Wen-Hsin Road, Taichung, Taiwan

[21] Appl. No.: 08/941,073

[22] Filed: Sep. 30, 1997

[51] Int. Cl.[7] ..... F04B 19/02; F04B 27/08

[52] U.S. Cl. ..... 417/307; 137/538; 251/63

[58] Field of Search ..... 417/307, 286, 417/287; 137/538; 251/63

[56] References Cited

U.S. PATENT DOCUMENTS

| | | | |
|---|---|---|---|
| 1,351,847 | 9/1920 | Gerhart | 417/468 |
| 3,442,502 | 5/1969 | Fischer et al. | 267/65 |
| 4,256,141 | 3/1981 | Peters | 137/557 |
| 4,291,718 | 9/1981 | Sanin et al. | 137/87 |
| 4,884,633 | 12/1989 | Le Gac et al. | 166/75.1 |
| 5,443,370 | 8/1995 | Wang | 417/238 |
| 5,507,626 | 4/1996 | Yang | 417/258 |
| 5,779,457 | 7/1998 | Chiang et al. | 417/467 |

*Primary Examiner*—Charles G. Freay
*Assistant Examiner*—Robert Z. Evora
*Attorney, Agent, or Firm*—Browdy and Neimark

[57] ABSTRACT

An air pump is provided with a head, a cylinder, a valve chamber, a branch duct, an air discharging hole, and an elastic member. The cylinder comprises a first air chamber, and a second air chamber smaller in the cross-sectional area than the first air chamber. When air pressure in an inflatable object being inflated by the air pump has reached a certain pressure level, a displacement member of the valve member is caused to displace so as to allow the air in the first air chamber to be released into the atmosphere via the branch duct and the air discharging hole. In the meantime, the pumping action is automatically switched to the second air chamber through which air is continuously pumped into the inflatable object.

9 Claims, 1 Drawing Sheet

AIR PUMP CAPABLE OF INFLATING AN INFLATABLE OBJECT REGARDLESS OF AIR PRESSURE LEVEL IN THE INFLATABLE OBJECT

FIELD OF THE INVENTION

The present invention relates generally to an air pump, and more particularly to an air pump capable of inflating an inflatable body rapidly even at a time when air pressure level in the inflatable body is high.

BACKGROUND OF THE INVENTION

The air pump with an air chamber of a large cross-sectional area is capable of inflating an inflatable object rapidly. However, the user of such air pump must make a greater physical effort to complete the inflating process. On the other hand, the pumping job can be made easier by reducing the cross-sectional area of the air chamber of the air pump. However, the pumping job can not be done rapidly with the air pump having an air chamber of a relatively small cross-sectional area. Generally speaking, the conventional air pumps are incapable of inflating an inflatable body rapidly at such time when air pressure level in the inflatable body is high.

SUMMARY OF THE INVENTION

The primary objective of the present invention is therefore to provide an improved air pump capable of inflating an inflatable body rapidly regardless of the air pressure level in the inflatable body.

In keeping with the principle of the present invention, the foregoing objective of the present invention is attained by an air pump, which is composed of a head, a cylinder, a valve chamber, a branch duct, an air discharging hole, and an elastic member. The cylinder comprises a first air chamber and a second air chamber smaller in the cross-sectional area than the first air chamber. When air pressure in an inflatable object being inflated by the air pump has reached a certain pressure level, a displacement member of the valve chamber is caused to displace so as to allow the air in the first air chamber to be released into the atmosphere via the branch duct and the air discharging hole. In the meantime, the pumping action is automatically switched to the second air chamber through which air is continuously pumped into the inflatable object.

The foregoing objective, features and functions of the present invention will be more readily understood upon a thoughtful deliberation of the following detailed description of an embodiment of the present invention with reference to the accompanying drawings.

DETAILED DESCRIPTION OF THE INVENTION

Figure 1:
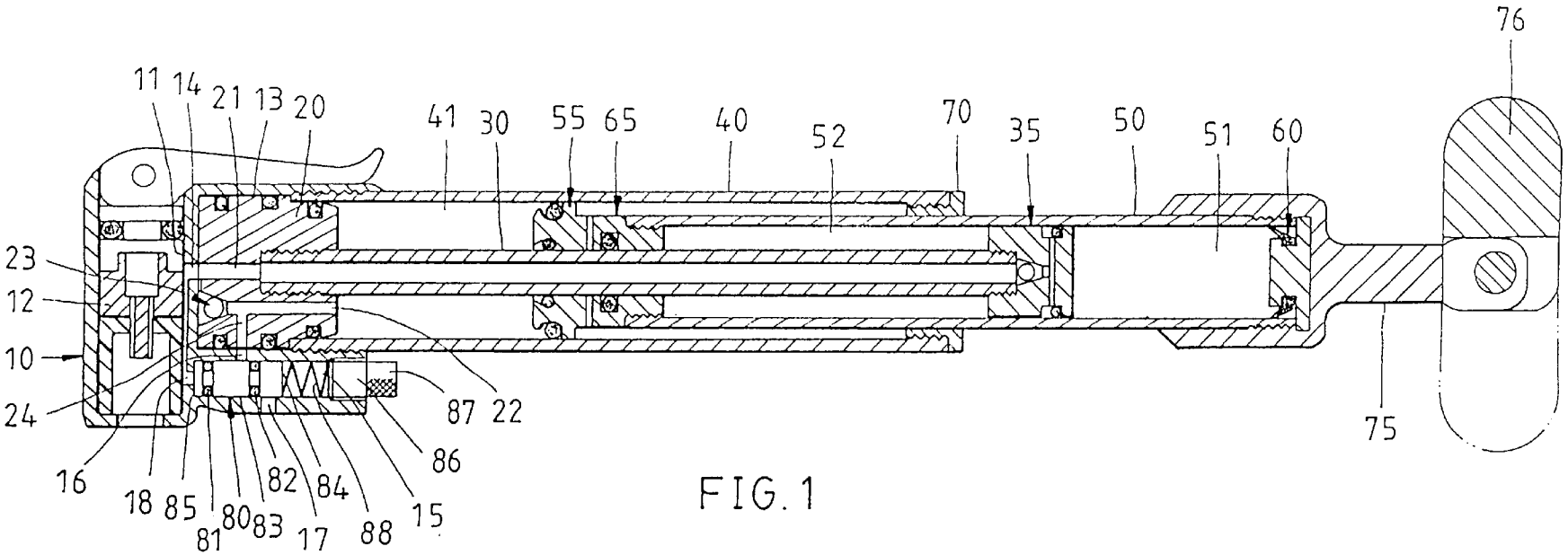
FIG. 1 shows a longitudinal sectional view of the present invention.
Figure 2:
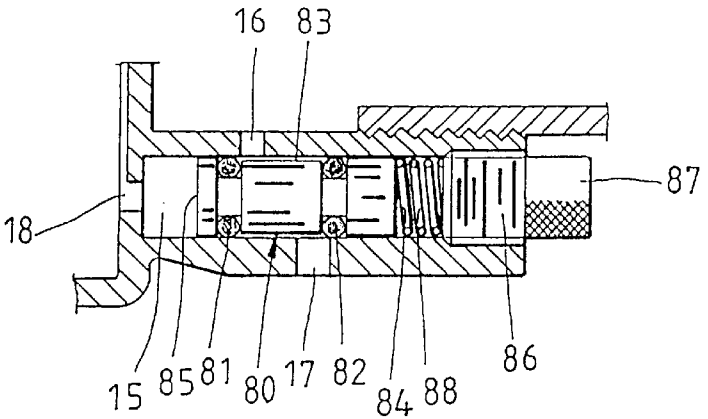
FIG. 2 shows a partial schematic view of the present invention at work.

As shown in FIG. 1, an air pump embodied in the present invention is composed of the component parts which are described explicitly hereinafter.

A head 10 is provided in the front end thereof with a receiving cell 11 and in the rear end thereof with a tubular cell 13. An air nozzle joint 12 is disposed in the receiving cell 11. The receiving cell 11 is in communication with the tubular cell 13 via an air admission hole 14.

A valve seat 20 is lodged in the tubular cell 13 of the head 10 and is provided in the center thereof with a first air duct 21 in communication with the air admission hole 14. The valve seat 20 is further provided with a second air duct 22 in communication with the air admission hole 14, and a check valve 23 permitting the air to flow to the air admission hole 14 via the second air duct 22.

An air guide tube 30 is fastened at a front end thereof with the center of the valve seat 20 such that the air guide tube 30 is in communication with the first air duct 21.

A bidirectional air admission piston 35 is fastened with a rear end of the air guide tube 30.

A fixed cylindrical tube 40 is fitted over the air guide tube 30 such that the fixed cylindrical tube 40 is fastened at a front end thereof with the tubular cell 13 of the head 10, and that the fixed cylindrical tube 40 is in communication with the second air duct 22.

A movable cylindrical tube 50 is fitted over the bidirectional air admission piston 35 such that the movable cylindrical tube 50 is located between the air guide tube 30 and the fixed cylindrical tube 40, and that the movable cylindrical tube 50 is capable of moving along the direction of the axis of the air guide tube 30.

A first unidirectional air admission valve 55 is disposed in a front end of the movable cylindrical tube 50 such that the first unidirectional air admission valve 55 and the valve seat 20 form therebetween a first air chamber 41. The first unidirectional air admission valve 55 allows atmospheric air to enter the first air chamber 41 in a one-way manner.

A second unidirectional air admission valve 60 is disposed in a rear end of the movable cylindrical tube 50 such that the second unidirectional air admission valve 60 and the bidirectional air admission piston 35 form therebetween a second air chamber 51. The second unidirectional air admission valve 60 permits atmospheric air to enter the second air chamber 51 in a one-way manner.

A third unidirectional air admission valve 65 is disposed in the front end of the movable cylindrical tube 50 such that the third unidirectional air admission valve 65 and the bidirectional air admission piston 35 form therebetween a third air chamber 52. The third unidirectional air admission valve 65 permits atmospheric air to enter the third air chamber 52 in a one-way manner.

An end cover 70 is fastened with the rear end of the fixed cylindrical tube 40 and is fastened pivotally with the movable cylindrical tube 50. The atmospheric air is capable of moving into the fixed cylindrical tube 40 via the interstices of the end cover 70.

A tail portion 75 is fastened with the rear end of the movable cylindrical tube 50 such that the atmospheric air is allowed to flow into the rear end of the movable cylindrical tube 50 via the interstices of the tail portion 75. The atmospheric air is further allowed to flow into the second air chamber 51 via the second unidirectional air admission valve 60. The tail portion 75 is provided at a rear end thereof with a handle 76 fastened pivotally therewith.

In operation, the movable cylindrical tube 50 is forced into the fixed cylindrical tube 40 so as to cause the air in the first air chamber 41 to be compressed by the first unidirectional air admission valve 55. The compressed air is then forced into the receiving cell 11 via the second air duct 22 of the valve seat 20 before the compressed air is injected into a tire via the air nozzle joint 12. The air in the second air chamber 51 is compressed by the bidirectional air admission piston 35. The compressed air is then forced into the air guide tube 30 via the bidirectional air admission piston 35 before the compressed air is introduced to the receiving cell 11 from which the compressed air is injected into the tire. When the movable cylindrical tube 50 is extracted from the fixed cylindrical tube 40, the air in the third air chamber 52 is compressed by the bidirectional air admission piston 35. The compressed air is then forced into the air guide tube 30 via the bidirectional air admission piston 35. The compressed air is introduced to the receiving cell 11 from which the air is injected into the tire.

The air pump of the present invention is characterized in that the head 10 is provided at the bottom of one end thereof with a valve chamber 15 of a columnar shape, a through hole 16, an air releasing hole 17 separated from the through hole 17 by a distance, a pressure hole 18, and a branch duct 24 in communication with the through hole 16. The pressure hole 18 is in communication with the valve chamber 15 and the receiving cell 11 of the head 10.

A displacement member 80 is disposed in the valve chamber 15 such that the displacement member 80 is capable of displacing along the direction of the axis of the valve chamber 15. The displacement member 80 is provided in the periphery thereof with two leakproof rings 81 and 82. The leakproof ring 81 is located between the pressure hole 18 and the through hole 16, whereas the leakproof ring 82 is located between the through hole 16 and the air releasing hole 17 at such time when the displacement 80 is located at the front position, as shown in FIG. 1. A ring-shaped air guiding portion 83 is formed between the periphery of the displacement member 80 and the wall of the valve chamber 15. A bolt 86 is engaged with the open end of the valve chamber 15 such that the knob 87 of the bolt 86 is located outside the valve chamber 15. The bolt 86 and a rear end face 84 of the displacement member 80 are urged respectively by two ends of a spring 88. The displacement member 80 is urged in the direction towards the pressure hole 18.

At the outset of inflating a tire, the air pressure in the receiving cell 11, the first air duct 21 and the air guide tube 30 is corresponding to the air pressure in the tire. As the air pressure of the tire is increased, the front end face 85 of the displacement member 80 is forced by the air pressure via the pressure hole 18 to move toward the rear end of the valve chamber 15.

When the air pressure in the tire is under a certain level, the branch duct 24 of the second air duct 22 is sealed off. Under this circumstance, the air pump of the present invention is in the state of forward stroke. In other words, the action of inflating the tire is executed by the first air chamber 41 and the second air chamber 51. As the air pressure in the tire is increased, the displacement member 80 is caused to displace. As soon as the air pressure in the tire has reached a certain level, the through hole 16 is in communication with the air releasing hole 17 via the air guiding portion 83. As a result, the branch duct 24 is in communication with the atmosphere. The air in the first air chamber 41 is let out to the atmosphere via the branch duct 24. That is, the air from the first chamber 41 flows transversely across the displacement member 80 past a transverse air guiding portion located between the leakproof rings 81 and 82. In the meantime, the tire is continuously being inflated by the second air chamber 51, which has a relatively smaller cross sectional area as compared to the first air chamber 41. When the air pressure in the tire is under a certain level, the rapid inflation of the tire is brought about by the first air chamber 41. As the air pressure in the tire has reached a certain high level, the inflation of the tire is easily brought about by the second air chamber 51. The action of inflating the tire by means of the first air chamber 41 or the second air chamber 51 can be adjusted by the bolt 86. The air releasing hole 17 may be provided with a whistle for making a clear and shrill sound as a reminder to the air pump operator as soon as the tire pressure has reached a desired level. The air guiding portion 83 of the displacement member 80 may be replaced by a through hole.

What is claimed is:

1. An air pump comprising:

a head provided with a receiving cell and an air nozzle joint located in said receiving cell;

a first air chamber in communication with said receiving cell;

a second air chamber in communication with said receiving cell;

a valve chamber including at one end thereof a pressure hole communicating with the receiving cell;

a displacement member slidably located in said valve chamber, said displacement member including an air guiding portion;

an elastic element urging said displacement member toward said pressure hole;

a branch duct communicating between said first air chamber and said valve chamber; and an air releasing hole communicating between said valve chamber and atmosphere;

wherein said air guiding portion is adapted to communicate between the branch duct and the air releasing hole;

whereby pressure in the receiving cell controls a position of the displacement member and selectively couples the first air chamber with the atmosphere.

2. The air pump as defined in claim 1, wherein said displacement member is provided with two leakproof rings, one of said two leakproof rings being located between said pressure hole and an opening of said branch duct, another one of said two leakproof rings being located between said branch duct and said air releasing hole when said displacement member is contiguous to said pressure hole; and wherein said air guiding portion of said displacement member is located between said two leakproof rings.

3. The air pump as defined in claim 1, wherein said head is further provided with a bolt fastened with an open end of said valve chamber such that said bolt is urged by one end of said elastic element, said elastic element including another end urging said displacement member.

4. The air pump as defined in claim 3, wherein said bolt has a knob which is located outside said valve chamber.

5. The air pump as defined in claim 1, wherein the pressure hole is in communication with said receiving cell of said head and said valve chamber.

6. The air pump as defined in claim 1, wherein air from the first chamber flows transversely across the air guiding portion.

7. In an air pump for an inflatable object, the pump being of the type including a first low-pressure air chamber, a second high-pressure air chamber, and an air receiving cell communicating with an air nozzle adapted to be coupled in communication with the inflatable object; the improvement comprising:

a valve responsive to pressure in the air receiving cell, the valve adapted to leak air from the low-pressure air chamber to atmosphere when the pressure in the air receiving cell reaches a certain level;

whereby air inflating action is automatically switched to the high-pressure air chamber.

8. The improvement according to claim 7, wherein the first low-pressure air chamber further comprises a low-pressure piston slidable within a low-pressure cylinder, wherein the second high-pressure air chamber further comprises a high-pressure piston slidable within a high-pressure cylinder, and wherein the second high-pressure air chamber is movable relative to the first low-pressure air chamber in a direction of an axis thereof.

9. The improvement according to claim 7, comprising a check valve between the air receiving cell and the first low-pressure air chamber.

* * * * *